US009468317B2

(12) United States Patent
Gorham

(10) Patent No.: US 9,468,317 B2
(45) Date of Patent: Oct. 18, 2016

(54) APPARATUS, SYSTEM, AND METHOD FOR SEALED FRAME MOUNT

(71) Applicant: Hunter Gorham, Houston, TX (US)

(72) Inventor: Hunter Gorham, Houston, TX (US)

( * ) Notice: Subject to any disclaimer, the term of this patent is extended or adjusted under 35 U.S.C. 154(b) by 0 days.

(21) Appl. No.: 13/827,322

(22) Filed: Mar. 14, 2013

(65) Prior Publication Data

US 2014/0150312 A1 Jun. 5, 2014

Related U.S. Application Data

(60) Provisional application No. 61/733,036, filed on Dec. 4, 2012.

(51) Int. Cl.

| | |
|---|---|
| ***A47G 1/06*** | (2006.01) |
| *G09F 1/12* | (2006.01) |
| *B44C 5/02* | (2006.01) |

(52) U.S. Cl.

CPC ..... *A47G 1/0633* (2013.01); *A47G 1/0638* (2013.01); *A47G 1/06* (2013.01); *B44C 5/02* (2013.01); *G09F 1/12* (2013.01); *Y10T 156/10* (2015.01)

(58) Field of Classification Search

CPC ..... A47G 1/06
USPC ..... 40/729, 782, 735, 792, 773, 124.5
See application file for complete search history.

(56) References Cited

U.S. PATENT DOCUMENTS 3,883,974 A * 5/1975 Ashton ..... 40/766
4,064,645 A * 12/1977 Wood ..... B65D 75/30 40/760
4,079,881 A * 3/1978 Sabb ..... B42D 15/027 229/92.8
4,579,768 A * 4/1986 Post ..... B44C 1/24 156/252
4,761,903 A * 8/1988 Cantrell ..... G09F 1/10 40/718
4,777,746 A * 10/1988 Brooks ..... 40/773
5,050,323 A * 9/1991 Gagnon ..... A44C 3/001 40/1.5
5,210,133 A * 5/1993 O'Lenick, Jr. ..... A61K 8/893 428/387
5,589,021 A * 12/1996 Bloom ..... B32B 37/02 101/32
6,460,280 B1 * 10/2002 Haines-Woon ..... 40/768
6,503,591 B2 * 1/2003 Kuo ..... B32B 5/18 283/81
6,574,896 B1 * 6/2003 Howell ..... 40/737
2002/0066218 A1 * 6/2002 Darby ..... 40/735
2005/0044766 A1 * 3/2005 Lanci ..... 40/732
2005/0155267 A1 * 7/2005 Hamilton ..... 40/734
2007/0033848 A1 * 2/2007 Rosenbaum et al. ..... 40/735
2009/0277580 A1 * 11/2009 Singer ..... B32B 37/203 156/325
2011/0146126 A1 * 6/2011 Phillips ..... A47G 1/0633 40/738
2011/0296728 A1 * 12/2011 Bolt ..... G09F 3/207 40/649
2014/0041270 A1 * 2/2014 Rosalsky ..... B44D 5/00 40/700

* cited by examiner

*Primary Examiner* — Syed A Islam
(74) *Attorney, Agent, or Firm* — Norton Rose Fulbright US LLP

(57) ABSTRACT

An apparatus, system, and method for a sealed frame mount system. The sealed frame mount system may include a front protective surface, such as a thermoplastic, and a piece of artwork. The piece of artwork is adhered to the front protective surface. The sealed frame mount system also includes a rear substrate, such as sheet of aluminum, and a rear support brace for mounting the sealed frame mount system to a wall for display.

22 Claims, 7 Drawing Sheets

APPARATUS, SYSTEM, AND METHOD FOR SEALED FRAME MOUNT

This application claims priority to U.S. Provisional Patent Application 61/733,036, entitled "Apparatus, System, and Method for Sealed Frame Mount System" filed 4 Dec. 2012, the entire disclosure of which is incorporated herein without disclaimer.

BACKGROUND OF THE INVENTION

1. Field of the Invention

This invention relates to frame mounts and more particularly relates to an apparatus system and method for sealed frame mount systems.

2. Description of the Related Art

Various methods have been used to mount artwork such as photographs. For example, photographs have been mounted to substrates such as foamcore, Gator Board, Sintra, and the like by taping the rear perimeter of the photograph or the corners of the photograph to the substrate. In addition, in some cases, a piece of glass or plexiglass has been used such that the photograph is positioned between the substrate and the glass or plexiglass.

Some of the solutions in the prior art suffer from bowing, bending, or rippling, especially with larger artwork (e.g. beyond 20"×30"). Prior art solutions include fastening the art inside a traditional frame or fastening the four corners of the art to the wall with stand off pegs that damage the walls and appear on the front of the art. In many instances, a bow, wave, or ripple in the final art is accepted and tolerated.

SUMMARY OF THE INVENTION

An apparatus for a sealed frame mount system is presented. In some embodiments, the apparatus includes a front protective surface, a piece of artwork, an adhesive for adhering the piece of artwork to the front protective surface, a rear substrate, and a rear support brace. In some embodiments, the adhesive may adhere substantially the entire piece of artwork to the front protective surface. In addition, the front protective surface may be made of a transparent thermoplastic, such as acrylic. In some embodiments, the front protective surface may be Plexiglass. In some embodiments, the front protective surface may be 0.25 inches thick, while in others it may be 0.125 inches thick or 0.0625 inches thick or 0.03125 inches thick.

In some embodiments, the piece of artwork may be a digital print of a photograph made on paper with an inkjet printer. Furthermore, the piece of artwork may include ink printed directly onto the front protective surface and the ink itself may serve to adhere the artwork to the front protective surface. In some embodiments, the ink may be printed directly onto the rear substrate.

In some embodiments, the rear substrate may be made of aluminum, which may be a sheet of 0.080 inch thick aluminum. In some embodiments, the rear substrate may include a thermoplastic, such as any acrylic. In some embodiments, the rear substrate may include a composite or other suitable material. In some embodiments, a second adhesive may be used for adhering the piece of artwork to the rear substrate. Moreover, the second adhesive may adhere substantially the entire piece of artwork to the rear substrate.

In some embodiments, the rear support brace may be made of aluminum tubes. Furthermore, a third adhesive may be used for adhering the rear substrate to the rear support brace.

In some embodiments, the sealed frame mount system may include two or more panels. For example, a first panel may include the front protective surface, the piece of artwork, the adhesive for adhering the piece of artwork to the front protective surface, the rear substrate, and the rear support brace as described above. In some embodiments, a second panel may include a second front protective surface, a second piece of artwork, a second adhesive for adhering the piece of artwork to the front protective surface, a second rear substrate, and a second rear support brace. In addition, in some embodiments, the piece of artwork and the second piece of artwork are parts of a single larger piece of artwork. In other words, the artwork may span across two or more panels. In some embodiments, the first piece of artwork and the second piece of artwork have a border. In other words, a border may span across two or more panels.

A method is also presented for making a frame. The method in the disclosed embodiments substantially includes the steps necessary to carry out the functions presented above with respect to the operation of the described apparatus and system. In one embodiment, the method includes adhering a piece of artwork to a front protective surface, adhering a rear substrate to the piece of artwork, and attaching a rear support brace to the rear support backing.

In some embodiments, adhering the piece of artwork to the front protective surface may include pressing an adhesive film to the front protective surface so as to remove substantially all air between the adhesive film and the front protective surface. Furthermore, adhering the piece of artwork to the front protective surface may include pressing the piece of artwork to the adhesive film so as to remove substantially all air between the adhesive film and the piece of artwork.

In some embodiments, adhering the rear substrate to the piece of artwork may include pressing an adhesive film to the rear substrate so as to remove substantially all air between the adhesive film and the rear substrate. Furthermore, it may include pressing the piece of artwork to the adhesive film so as to remove substantially all air between the adhesive film and the rear substrate. In some embodiments, the method may also include first pressing an adhesive film to the artwork and then pressing the rear substrate to the backside of the adhesive film on the artwork.

In some embodiments, the methods disclosed herein may include attaching a support brace to the rear substrate. Furthermore, the methods may include removing a portion of the adhered front protective surface, piece of art work, and rear substrate. In some embodiments, the methods may also include polishing the edges of the front protective surface and rear substrate.

The term "coupled" is defined as connected, although not necessarily directly, and not necessarily mechanically.

The terms "a" and "an" are defined as one or more unless this disclosure explicitly requires otherwise.

The term "substantially" and its variations are defined as being largely but not necessarily wholly what is specified as understood by one of ordinary skill in the art, and in one non-limiting embodiment "substantially" refers to ranges within 10%, preferably within 5%, more preferably within 1%, and most preferably within 0.5% of what is specified.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a method or device that "comprises," "has," "includes" or "contains" one or more steps or elements possesses those one or more steps or elements, but is not limited to possessing only those one or more elements. Likewise, a step of a method or an element of a device that "comprises," "has," "includes" or "contains" one or more features possesses those one or more features, but is not limited to possessing only those one or more features. Furthermore, a device or structure that is configured in a certain way is configured in at least that way, but may also be configured in ways that are not listed.

Other features and associated advantages will become apparent with reference to the following detailed description of specific embodiments in connection with the accompanying drawings.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

DETAILED DESCRIPTION

Various features and advantageous details are explained more fully with reference to the nonlimiting embodiments that are illustrated in the accompanying drawings and detailed in the following description. Descriptions of well-known starting materials, processing techniques, components, and equipment are omitted so as not to unnecessarily obscure the invention in detail. It should be understood, however, that the detailed description and the specific examples, while indicating embodiments of the invention, are given by way of illustration only, and not by way of limitation. Various substitutions, modifications, additions, and/or rearrangements within the spirit and/or scope of the underlying inventive concept will become apparent to those skilled in the art from this disclosure.

Figure 1:
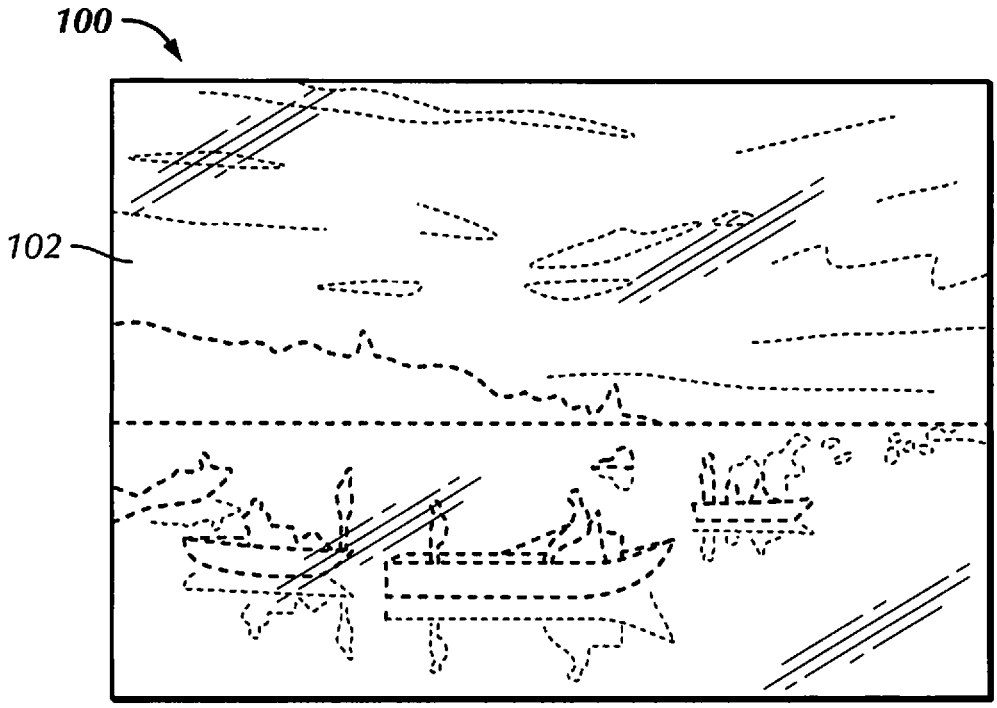
FIG. 1 is a diagram illustrating one embodiment of a sealed frame mount system without a border around the artwork.

FIG. 1 illustrates one embodiment of a sealed frame mount system 100. In one embodiment, the sealed frame mount system 100 includes a piece of artwork 102.

The piece of artwork 102 may be a photograph that is printed onto paper using an inkjet printer. Such printing is sometime referred to as Giclée. Giclée printing can produce photographs with higher definition and higher color saturation than other forms of printing. For example, the size and quantity of ink drops (which may be measured in picoliters) used can be controlled to affect the quality of the photograph. In some embodiments, as the ink drops get smaller, the photograph becomes sharper and more accurate. In addition, in some embodiments, as the number of ink drops used increases, the brightness and color quality increase.

Various types of ink may be used with inkjet printing used for artwork displayed using a sealed frame mount system. For example, in some embodiments, archival ultraviolet (UV) resistant ink may be used to reduce or eliminate fading, maintain brightness, and increase the life of the art as compared with traditional inks. In addition, UV-resistant ink may prevent fading and may offer more flexibility as to where art can be displayed, such as in brightly lit areas and even outside. The archival nature of the UV-resistant ink and the flexibility as to where the artwork can be displayed can increase the value of the sealed frame mount system.

Various types of paper can be used with artwork displayed using a sealed frame mount system. In one embodiment, the artwork can be printed on a high-grade pearl photographic paper with metallic properties. The metallic properties in the paper may be highly reflective and have a more heightened response to light than traditional glossy or matte papers. The metallic properties may make the color and contrast dynamic (appear to change) with changes in incident light. Moreover, metallic properties may provide a unique luster, gloss, or sparkle in the print, which may not be available in traditional paper. As the intensity of light is increased, the metallic properties may reflect the light in a way that causes colors to become more saturated. This effect may be used to cause an image of a sun over a horizon, for example, to appear to be a sunset or a sunrise as light is dimmed or brightened, respectively.

Although digital photographs are described in detail herein, it should be appreciated that the sealed frame mount systems disclosed herein are not limited to such photographs. The sealed frame mount systems may be used with traditional non-digital photography as well as other types of pictures and artwork. For example, the sealed frame mount systems described herein may be used for mounting advertisements, signs, prints, posters, paintings, maps, or directories.

Figure 2:
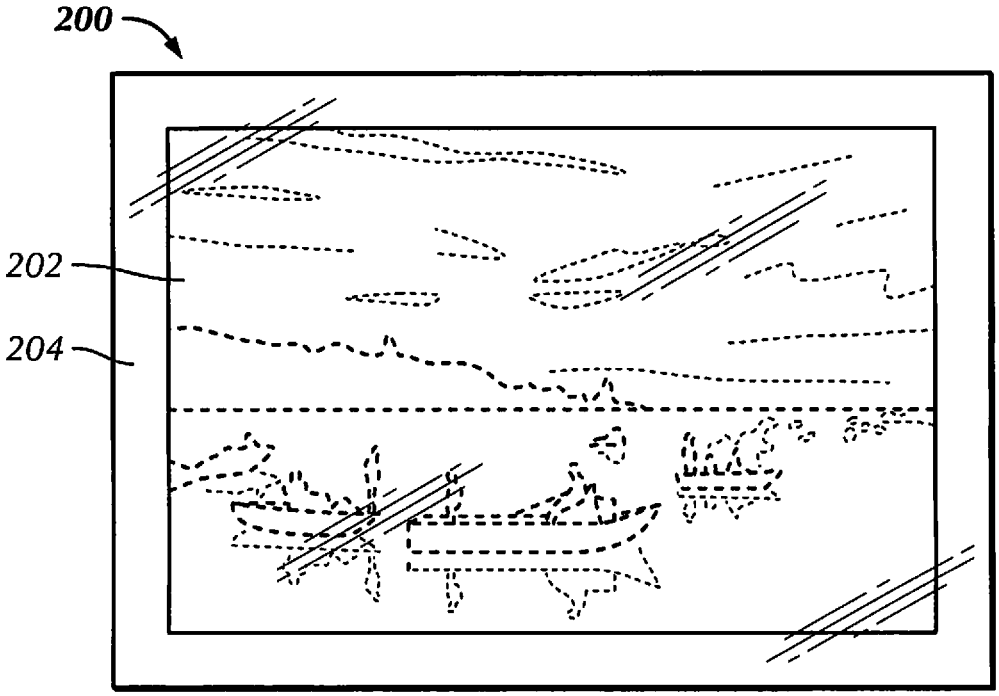
FIG. 2 is a diagram illustrating one embodiment of a sealed frame mount system with a border around the artwork.

FIG. 2 illustrates one embodiment of a sealed frame mount system 200 with a piece of artwork 202 and a frame border 204 that surrounds the artwork 202. Because artwork 202 can be printed, as described above, photo design software, such as Adobe Photoshop, may be used to create and prepare a frame border 204 to provide a finished edge design. For example, a photograph covering a rectangular area of 20"×30" can be printed on a sheet of paper measuring 25"×35," which would leave a 2.5" frame border on all four sides of the photograph. Although in some embodiments the frame border 204 may be blank (e.g. paper without anything printed on it), in some embodiments, the frame border 204 can be printed with particular patterns, and may include customized colors and patterns. For example, the frame border 204 may be printed with an image that resembles a wooden picture frame. The ability to include the frame border 204 in the sealed frame mount system 200 allows the frame border 204 to be customized with the artwork 202 and may become part of the artwork 202 without additional expense and may benefit from the same advantages of the rest of the sealed frame mount system 200. For example, unlike traditional wood frames that are susceptible to UV, light, heat, and moisture, frame border 204 may be sealed and integrated with the sealed frame mount system 200. The integration can essentially create a single piece of art and can reduce or eliminate parts or assembly required with traditional frames, which may make the sealed frame mount system easier to install than traditional frames. Moreover, the integration prevents the possibility that the artwork 202 may shift with respect to the frame border 204.

Because the frame border 204 can be part of the same paper on which artwork 202 is printed, it can create a flat face, eliminate seams, gaps, and lines and can create a final art piece with a cleaner and sleeker design than art installed in traditional frames. Moreover, the flat face associated with frame border 204 may allow a customer to have the framed border, but still maintain the option and ability to attach an additional frame.

The use of a frame border 204 permits unlimited frame choices and customization for little or no additional cost or time. For example, it allows a designer of the frame border 204 to essentially have a "blank canvas" to create and design her own frame. Any color, design, pattern, or symbol, for example, can quickly and easily be inserted into the frame border 204. In addition, the frame border 204 may make a piece of artwork, such as the sealed frame mount system 200, larger than without the frame border 204 with a minimal increase in the cost of the paper and little or no increase in the cost of printing. For example, a piece of artwork 202 that measures 20"×30" can be printed on a piece of paper that measures 25"×35." Assuming that the printer can accept the larger paper, the cost of printing a 20"×30" photo on a 20"×30" piece of paper vs. a 25"×35" piece of paper should be essentially the same. However, the overall product measures 875 sq. in. (25"×35") with the frame border 204, instead of 600 sq. in. (20"×30") without the frame border 204. Therefore, the area of the product increases by more than 45% with a minimal increase in printing cost. Because increased overall size of the framed art may increase the value, the ability to increase the size without significantly increasing the cost of production may make the art more profitable. By comparison, traditional frames get significantly more expensive as they increase in size. The table below includes the percentage of area increases for artwork with and without frame borders. These dimensions are given by way of example only. Additional frame border 204 sizes can be used.

| Dimensions Without Frame Border | Dimensions With Frame Border | Percentage Increase in Area |
|---|---|---|
| 20" × 30" | 25" × 35" | 45.83% |
| 37" × 56" | 40" × 60" | 15.83% |
| 30" × 90" | 35" × 95" | 23.15% |

As discussed above, the paper that can be used with the sealed frame mount system 200 includes metallic paper such as pearl paper. Therefore, the frame border 204 may exhibit a metallic luster or sparkle that may not be available with traditional frames, or may cost more to implement.

Figure 3:
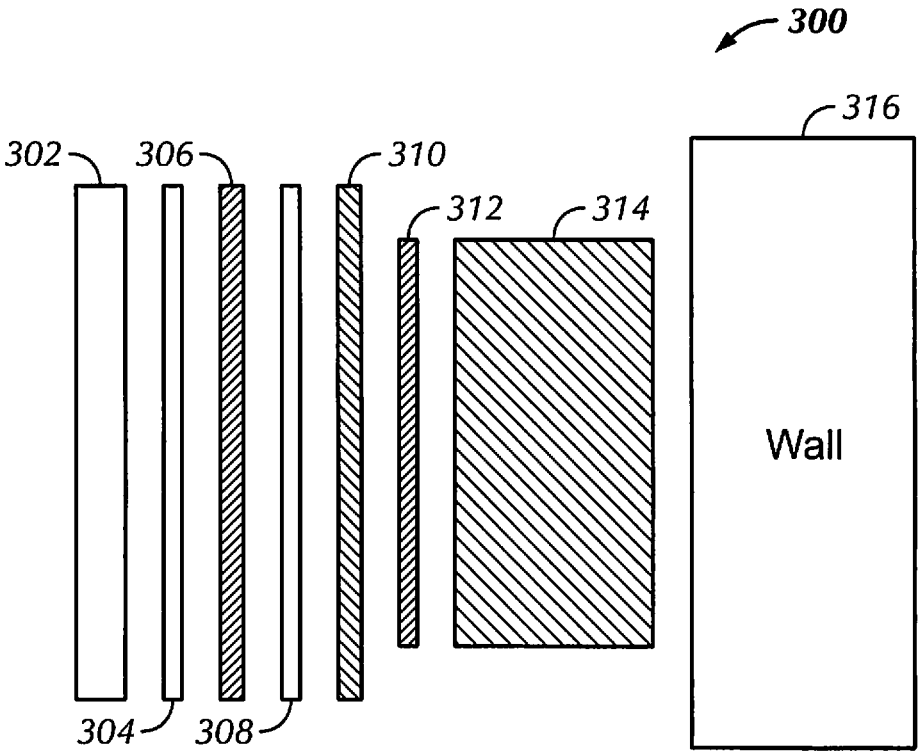
FIG. 3 is a schematic block diagram illustrating a cross sectional view of a sealed frame mount system.

FIG. 3 illustrates a schematic diagram of a sealed frame mount system 300. Front protective surface 302 is made of a transparent material, such as glass, thermoplastic (e.g. acrylic, plexiglass, or an alkali-aluminosilicate glass such as Gorilla Glass), or other suitable material. In some embodiments, the front protective surface 302 is a 0.25" thick piece of thermoplastic. Thermoplastic may be shatterproof and lighter than glass, which may allow for easier mounting, reduced shipping and packaging costs, improved safety, and fewer damaged product returns. In some embodiments, the front protective surface 302 may also increase the UV resistance of the sealed frame mount system 300.

The artwork 306 is face mounted to the front protective surface 302. First adhesive layer 304 is shown adjacent to front protective surface 302. In some embodiments, the first adhesive layer 304 may be a transparent film adhesive such as Optimount, and may be optically clear, double sided, thin and pliable. In some embodiments, the first adhesive layer 304 may be an adhesive that may be pressed, poured, sprayed, brushed, or rolled. The first adhesive layer 304 serves to adhere the front side (side that shows the art) of artwork 306 to the front protective surface 302. Although shown separated by gaps in FIG. 3, once assembled, front protective surface 302, first adhesive layer 304 and artwork 306 may be pressed or mounted together so as to substantially remove all air between artwork 306 and front protective surface 302 and create an airtight seal.

The front protective surface 302, first adhesive layer 304 and artwork 306 may be assembled using a press mount machine, which may ensure that no air is trapped between artwork 306 and front protective surface. In addition, the press mount machine may simultaneously remove a release strip from the first adhesive layer 304 while making the seal between the artwork 306 and front protective surface 302. Once pressed together, the artwork 306 will be firmly mounted to the front protective surface 302, which ensures that the artwork 306 is flush with the front protective surface and provides for an improved visual display. Other methods of assembling the front protective surface 302, first adhesive layer 304 and artwork 306 may be used. For example, in some embodiments, these elements may be pressed by hand. In some embodiments, the elements may be assembled in a vacuum to ensure that no air, dust or other contaminants enter the space between the artwork 306 and the front protective surface 302.

The first adhesive layer 304 can cover substantially the entire front surface of artwork 306 to adhere to the front protective surface 302, which can create a strong and lasting sealed frame mount system. Because the artwork 306 is flush with the front protective surface 302, visual characteristics of the artwork 306, such as light, color, detail, and definition, may be improved and the artwork 306 may be less affected by warp, bending, ripples, or bows. The artwork 306 maintains its straight and clean shape. Furthermore, the sealed frame mount system 300 ensures that the artwork is sealed from the environment and not exposed to moisture or dust. In addition, the seal between the artwork 306 and front protective surface 302 creates a protective environment for the adhesive 304, which extends the life of the adhesive itself, which can in turn extend the life of the sealed frame mount system.

In some embodiments, the artwork 306 may be printed directly onto the front protective surface 302. For example, a photograph may be printed on a piece of plexiglass or acrylic. In such an embodiment, the ink itself may serve to adhere the artwork to the front protective surface and an additional adhesive may not be necessary. As with other embodiments disclosed herein, if the artwork 306 is printed directly onto the front protective surface, the artwork 306 would be sealed and not exposed to dust, contaminants, moisture, air or heat.

Second adhesive layer 308 is adhered to the backside of artwork 306. Second adhesive layer 308 may be the same type of adhesive as first adhesive layer 304, or may be a different adhesive (such as print mount). The second adhesive layer 308 adheres the backside of the artwork 306 to a rear substrate 310. Because the second adhesive layer 308 adheres to the back side of the artwork 306, it does not necessarily have to be transparent like the first adhesive layer 304. The artwork 306, second adhesive layer 308, and rear substrate 310 may be assembled using a press mount machine, which may ensure that no air is trapped between artwork 306 and rear substrate 310. In addition, the press mount machine may simultaneously remove a release strip from the second adhesive layer 308 while making the seal between the artwork 306 and rear substrate 310. This method may help reduce the possibility of dust, contaminants, moisture, air or heat from entering the space between the artwork 306 and rear substrate 310. Dust and air (bubbles) may be visible even from the front side of the artwork 306. In some embodiments, rear substrate 310 may be a straight, non-porous material, such as a sheet of 0.080" thick 6061 aluminum. In some embodiments, the rear substrate 310 may be a thermoplastic, such as plexiglass, acrylic, or Sintra PVC or other suitable material. Like with the front protective surface 302, once assembled the artwork 306 and the rear substrate 310 may be substantially free of air. A rear substrate 310 made of aluminum, is strong, which helps keeps a straight shape for the presentation of the artwork. However, it is also thin and pliable, which allows the sealed frame mount system 300 to be assembled in a press mount machine. Because the rear substrate 310 is nonporous, it protects the artwork from harmful elements, which extends the life of the sealed frame mount system. For example, an aluminum rear substrate 310 prevents humidity from reaching the artwork 306 or the second adhesive layer 308. In addition, an aluminum rear substrate 310, for example, is strong, which allows for the mounting of large pieces of art while reducing bowing or bending. Moreover, because second adhesive layer 308 can cover substantially the entire back surface of artwork 306 to adhere to the rear substrate 310, it can create a strong and lasting sealed frame mount system.

In some embodiments, the front protective surface 302, artwork 306, and rear substrate 310 can be cut after being assembled as described above. For example, the front protective surface 302, artwork 306, and rear substrate 310 can be cut in a die cutting machine to particular dimensions by removing a portion of the adhered front protective surface, piece of art work, and rear substrate. For example, in some embodiments, the corners of the sealed frame mount may be rounded, which may reduce sharp edges. In addition, the edges can be polished to provide for a clean and finished look while removing sharp edges. In some embodiments, an acrylic polishing bit may simultaneously cut and polish the edges of the sealed frame mount system. The resultant art piece may then have smooth edges that may be safely handled.

Figure 4:
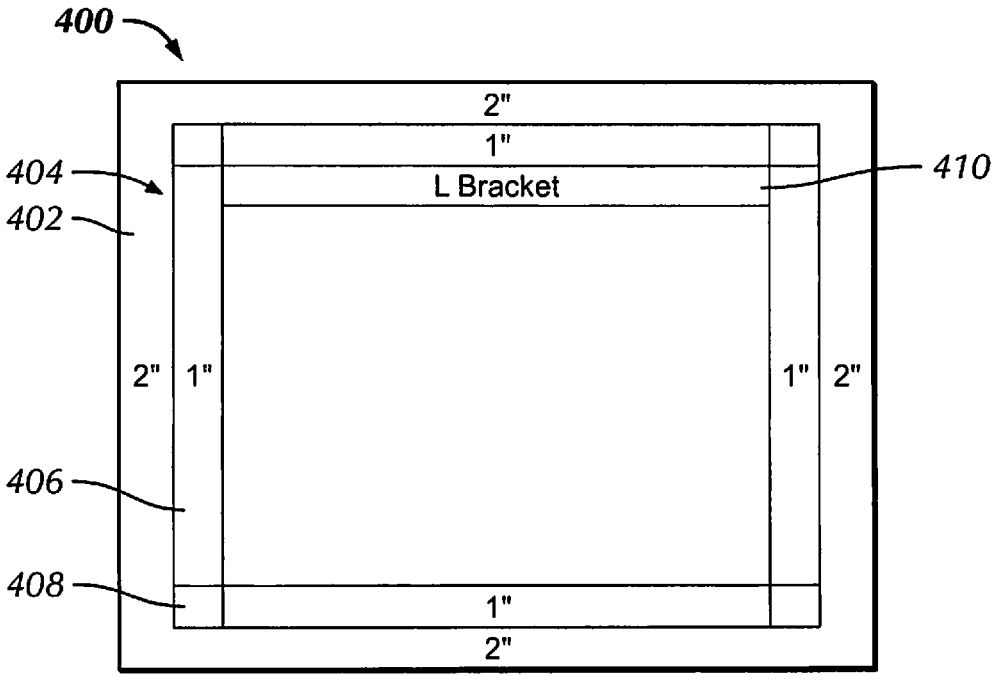
FIG. 4 is a diagram showing a rear view of one embodiment of a sealed frame mount system.

FIG. 4 shows a rear view of a sealed frame mount system 400. In this figure, the rear surface of the rear substrate 402 (element 310 in FIG. 3) is visible. Attached to the rear surface of the rear substrate 402 is a support brace 404 (element 314 in FIG. 3) that is made of four support tubes 406 and four corner brace connectors 408. In this embodiment, the support tubes 406 are 1 inch thick. Although not visible in FIG. 4, support tubes 406 may be 1 inch square extruded hollow aluminum tubes. Also in this embodiment, the support brace is dimensioned to allow for two (2) inches of clearance between the support brace and the outer edges of rear substrate 402. In some embodiments, a support bracket 410 may be attached to the support brace. The support bracket may be an "L" bracket that would allow one to mount the sealed frame mount system 400 to the wall. The support bracket 410 may be attached to the support brace by rivet, adhesive (such as double-sided tape), or weld, for example. In some embodiments, the support bracket 410 may be attached to the support tube 406 with a rivet and an adhesive such as Gorilla Glue. The support bracket 410 may then be mounted to the wall using a z-bar French cleat, gallery hanging cables, nails, or screws, for example. The cleat, along with the support bracket, can help simplify installation to make sure the sealed frame mount system is mounted level. In addition, the support bracket 410 may allow for multiple points of support to be attached to the wall for mounting, which may allow for a strong and secure mount. Support brace 404 may be made of extruded aluminum, which is strong, lightweight, straight, durable, and relatively inexpensive.

Figure 5:
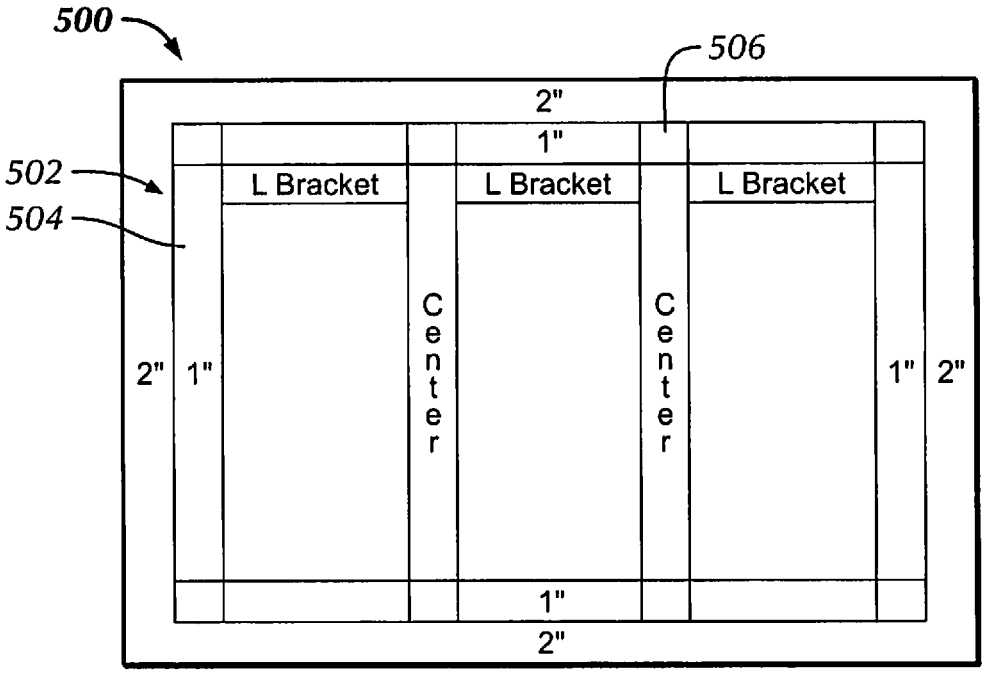
FIG. 5 is a diagram showing a rear view of one embodiment of a sealed frame mount system.

FIG. 5 shows another embodiment of a sealed frame mount system 500. In this embodiment, the support brace 502 is made of ten (10) support tubes 504. Such a configuration may provide more support for a sealed frame mount system 500. For example, a support brace as shown in FIG. 5 may be useful for a large sealed frame mount system which may be more susceptible to bowing or bending. In some embodiments, sealed frame mount systems 500 may be eight (8) feet or longer in width or height, yet have little bowing or bending, even with an overall weight that can exceed 60 pounds. The support tubes 504 are shown as being coupled together with corner brace connectors 506. However, in some embodiments, at least some of the support tubes 504 may be coupled together using other methods, such as using screws and hardware or welding.

Figure 6:
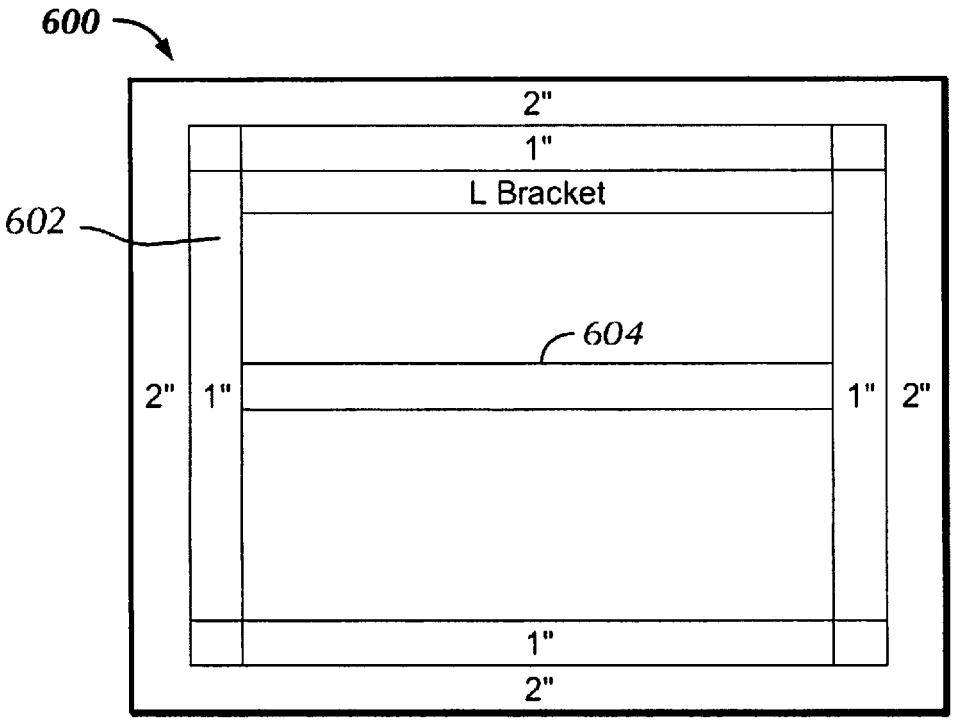
FIG. 6 is a diagram showing a rear view of a sealed frame mount system.

FIG. 6 shows an embodiment of a sealed frame mount system 600 which has a support brace 602 with a center tube 604. This embodiment has fewer pieces than the embodiment shows in FIG. 5 and may be suitable for some sizes and weights of sealed frame mount systems.

It should be noted that the support braces shown in FIGS. 4, 5 and 6 may be used regardless of whether the artwork is printed on its own paper or surface, directly on the front protective surface, or direct to the rear substrate. FIGS. 4, 5 and 6 may also be used with all embodiments disclosed herein of the front protective surface.

The schematic flow chart diagrams that follow are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 7:
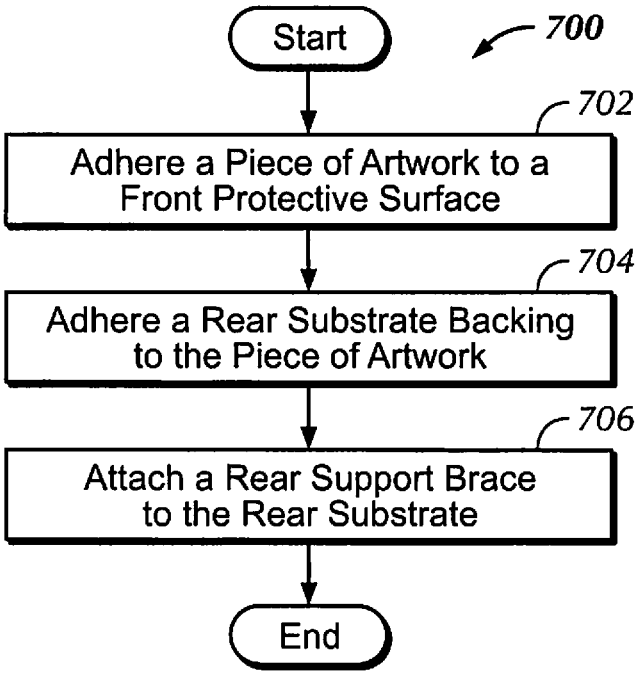
FIG. 7 is a flow chart showing one embodiment of a method for creating a sealed frame mount system.

FIG. 7 illustrates a schematic flow chart diagram for one embodiment of a method 700 for making a sealed frame mount system. In one embodiment, the method 700 starts step 702 of adhering a piece of artwork to a front protective surface. As described above, the step of adhering a piece of artwork to a front protective surface may include, for example, using a thin film adhesive on the back side of a clear surface such as a piece of thermoplastic. The artwork may then be pressed against the front protective surface to create a sealed, air-tight construction that is free of air, heat, dust, or other contaminants. Method 700 then goes on to step 704 of adhering a rear substrate back to the piece of artwork. In some embodiments, a thin film of adhesive may be used to adhere the back side of the artwork to a rear substrate such as a sheet of aluminum. Again, the step of adhering the artwork to the rear substrate may include pressing the artwork and rear substrate to create a sealed, air-tight construction that is free of air, dust, or other contaminants. Finally, method 700 includes the step 706 of attaching a rear support brace to the rear substrate. As described above, attaching the rear support brace to the rear substrate may include using rivets, double-sided tape, and/or expanding adhesive such as Gorilla Glue.

Figure 8:
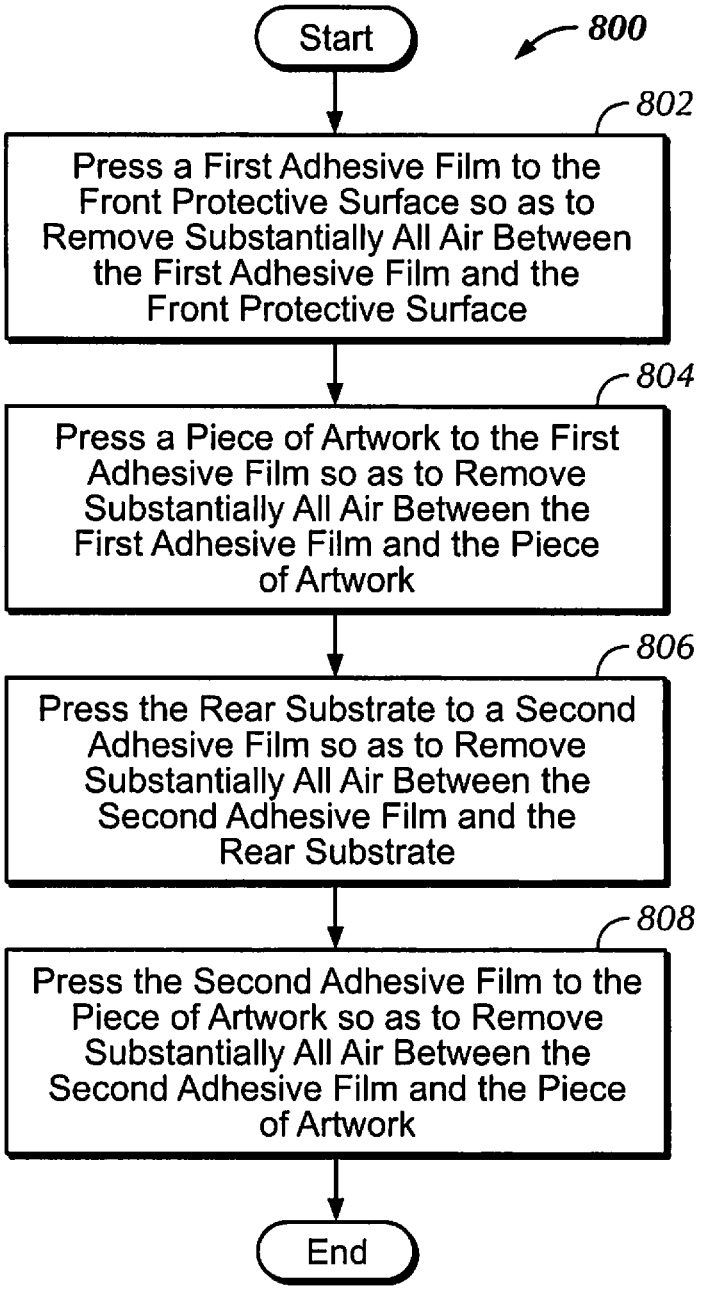
FIG. 8 is a flow chart showing one embodiment of a method for creating a sealed frame mount system.

FIG. 8 shows a schematic flow chart diagram for one embodiment of a method 800 for a method for making a sealed frame mount system. Step 802 includes pressing a first adhesive film to the front protective surface so as to remove substantially all air between the first adhesive film and the front protective surface. In some embodiments, this may be accomplished by using a press machine with rollers that remove substantially all air between the first adhesive film and the front protective surface. Step 804 includes pressing the piece of artwork to the first adhesive film so as to remove substantially all air between the first adhesive film and the piece of artwork. Again, in some embodiments, this may be accomplished by using a press machine with rollers that remove substantially all air between the first adhesive film and the front protective surface. In some embodiments, step 802 and 804 may be done simultaneously as the first adhesive film and artwork are pressed against the front protective surface. Step 806 includes pressing a second adhesive film to the rear substrate so as to remove substantially all air between the second adhesive film and the rear substrate. Step 808 includes pressing the piece of artwork to the second adhesive film so as to remove substantially all air between the second adhesive film and the piece of artwork. Assuming that the front surface of the piece of artwork has been adhered to the front protective surface, the second adhesive film in step 808 will be adhered to the back side of the artwork. As with steps 802 and 804, steps 806 and 808 may be accomplished simultaneously in a press machine with rollers to substantially remove all air between the artwork and the rear substrate. The order of steps 802-808 in FIG. 8 are disclosed by way of example, not limitation. For example, in some embodiments, the steps may be performed in different orders. In one such example, steps 806 and 808 may occur before steps 802 and 804. As such, in some embodiments, the artwork may be adhered to the rear substrate before the front protective surface is adhered to the artwork.

Figure 9:
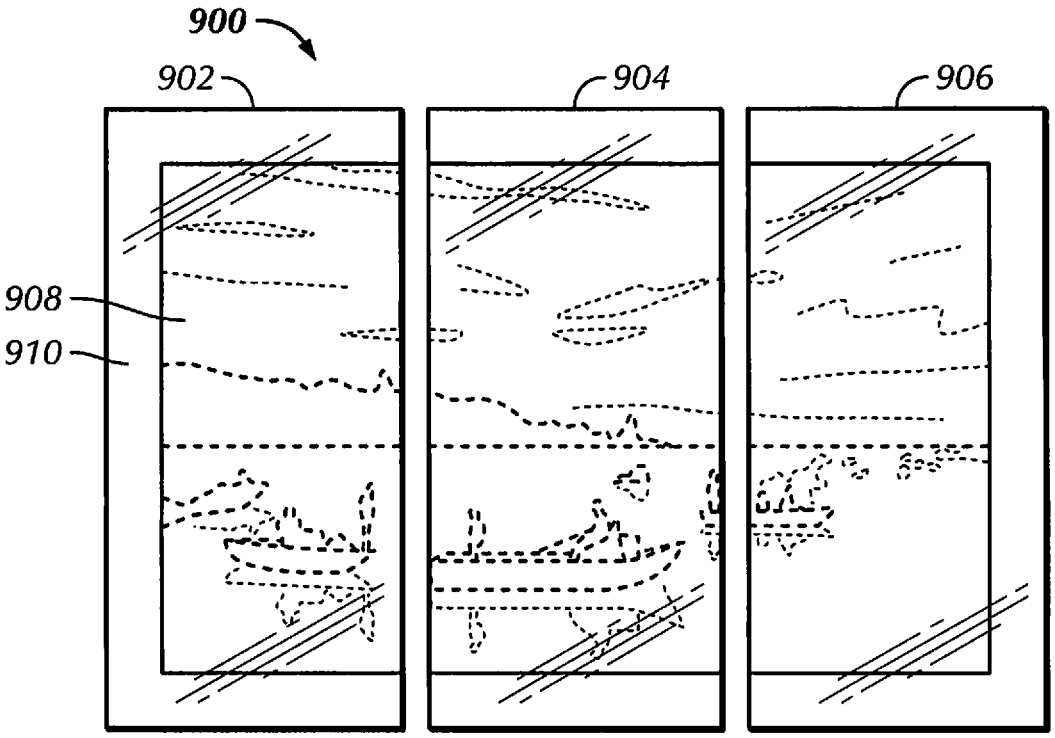
FIGS. 9-10 are diagrams illustrating embodiments of sealed frame mount systems.
Figure 10:
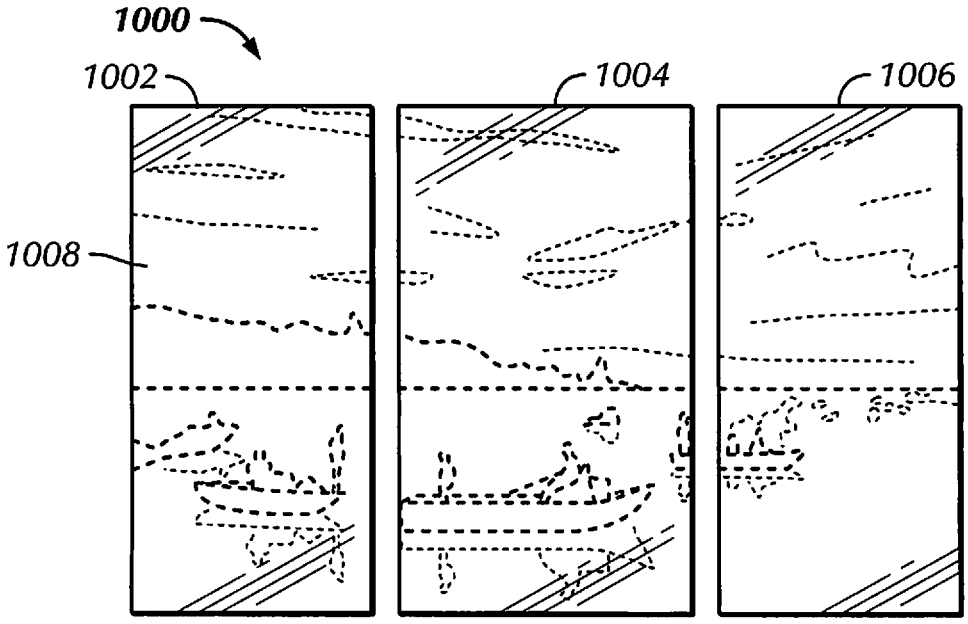

In some embodiments, the sealed frame mount system may also be used to create and display a single piece of artwork that spans multiple panels and may be larger than what is possible in one panel. For example, most photograph papers, thermoplastics, front protective surfaces and rear substrates are not available in sizes larger than 48"×96". The sealed frame mount system can be used to print and display artwork in multiple 48"×96" panels, or other suitable sizes, where each panel shows only a portion of the artwork. The panels may be hung next to each other to display the complete artwork, and the total size of the artwork may far exceed the 48"×96" limitation of one panel. By way of example configurations may include two, three, four, five, six, or more panels, and each panel can be virtually any size. In a multiple-panel configuration, any bowing, waves, or imperfections in the panels may be highly problematic because the hung panels may display unevenly. Additionally, bowing or imperfections in the panels could also cause lines across the artwork to not align from one panel to the next. The sealed frame mount system enables each panel to be flat, straight and smooth. Thus, the sealed frame mount system is beneficial for multiple panel configurations to ensure proper alignment and flawless display across panels and with the complete artwork. Finally, the sealed frame mount system also enables multiple panel artwork to have a frame border that permits unlimited frame choices and customization for little or no additional cost or time. Any color, design, pattern, or symbol, for example, can quickly and easily be inserted into the frame border along the panels. FIGS. 9 and 10 show two embodiments of a multiple panel configuration.

FIG. 9 shows one embodiment of a sealed frame mount system 900 having three panels 902, 904, 906. In this embodiment, a single piece of artwork is 908 is distributed on the three separate panels 902, 904, and 906. Moreover, the sealed frame mount system 900 includes a border 910 that frames the artwork 908 across the three panels (rather than frame each individual panel). Each sealed frame mount system panel 902, 904, or 906 may be made of any of the embodiments disclosed herein for sealed frame mount systems. Similarly, border 910 may include any of the embodiments disclosed herein for borders.

FIG. 10 shows one embodiment of a sealed frame mount system 1000 having three panels 1002, 1004, and 1006. A single piece of artwork 1008 is distributed on the three separate panels 1002, 1004, and 1006. Unlike sealed frame mount system 900, sealed frame mount system 1000 does not include a border. However, like sealed frame mount system 900, in sealed frame mount system 1000 each panel may be made of any of the embodiments disclosed herein for sealed frame mount systems. Moreover, although not shown, sealed frame mount systems may be made using two panels or four or more panels consistent with the disclosure herein.

Figure 11:
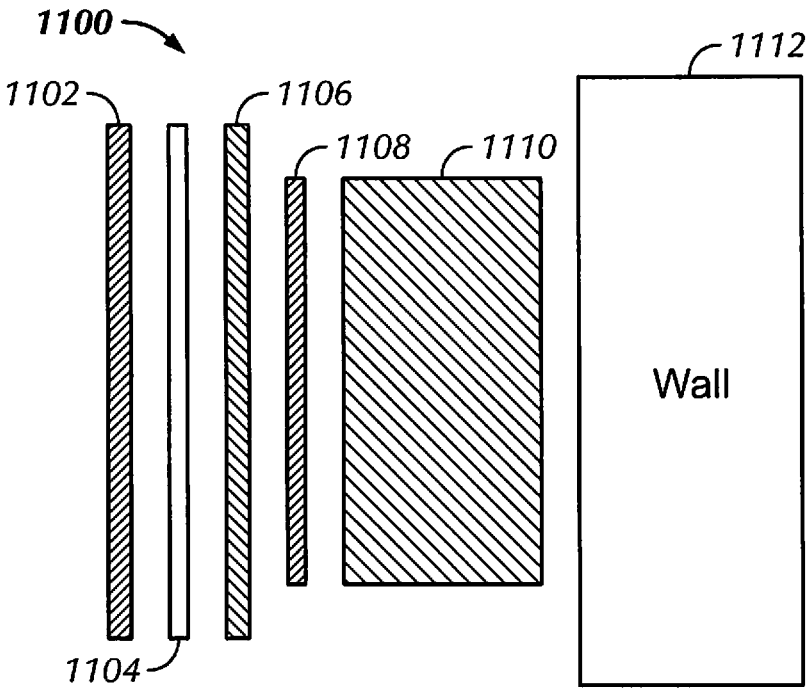
FIG. 11 is a schematic block diagram illustrating a cross sectional view of a sealed frame mount system.

FIG. 11 shows one embodiment of a sealed frame mount system 1100. Sealed frame mount system 1100 includes a front protective surface 1102, a piece of artwork 1104, a rear substrate 1106, an adhesive 1108, and a support brace 1110 configured to attach to a wall 1112, for example. Unlike the embodiment disclosed in FIG. 3 and described above, the embodiment disclosed in FIG. 11 does not have separate adhesive layers between the artwork and the front protective surface and the artwork and the rear substrate. For example, the artwork 1104 may be printed directly onto the rear substrate 1106. The rear substrate 1106 may be made of a dibond or aluminum composite panel (i.e. a double-sided aluminum substrate with a polyethylene core, or other similar suitable material). Aluminum dibond is archival, stable, highly durable, and can be used both indoors and outdoors. UV cured inks can be used to print the artwork 1104 onto the rear substrate 1106. A flatbed printer can both print the artwork and cure the UV ink with UV lights, nearly simultaneously. UV cured inks are durable, resilient against outdoor weather conditions and provide strong color retention. In such an embodiment, the ink itself may serve to adhere the artwork 1104 to the rear substrate 1106 and an additional adhesive may not be necessary. As with other embodiments disclosed herein, if the artwork 1104 is printed directly onto the rear substrate, the artwork 1104 would be sealed and not exposed to dust, contaminants, moisture, air or heat on the back side of the artwork.

In some embodiments, the front protective surface 1102 is a made of a transparent laminate. The laminate can be rolled, brushed, poured, sprayed or pressed on the artwork 1104. For example, a UV-cured liquid laminate may be rolled onto the artwork 1104 using a flatbed machine that both applies and cures the liquid laminate. The liquid laminate provides added durability, scratch resistance, outdoor weather protection, and color fade defense for the underlying artwork 1104. In such an embodiment, the liquid laminate itself may serve to adhere the front protective surface 1102 to the artwork 1104 and an additional adhesive may not be necessary. As with other embodiments disclosed herein, if the front protective surface 1102 is a laminate applied on top of the artwork 1104, the artwork 1104 would be sealed and not exposed to dust, contaminants, moisture, air or heat.

Adhesive layer 1108 attaches to the rear substrate 1106. In some embodiments, adhesive layer 1108 may be industrial double-sided tape. Adhesive layer 1108 adheres rear substrate 1106 to support brace 1110. In some embodiments, support brace 1110 may be made of 1" hollow aluminum tubes, such as extruded aluminum tubes as described above. Support brace 1110 may be used to attach or mount the sealed frame mount system 1100 to wall 1112. It should be noted that adhesive layer 1108 and support braces 1110 are applicable whether the artwork is printed on its own paper or surface, direct to the front protective surface 1102, or directly to the rear substrate 1106. Adhesive layer 1108 and support braces 1110 may also be used with all previously-mentioned embodiments of the front protective surface.

Figure 12:
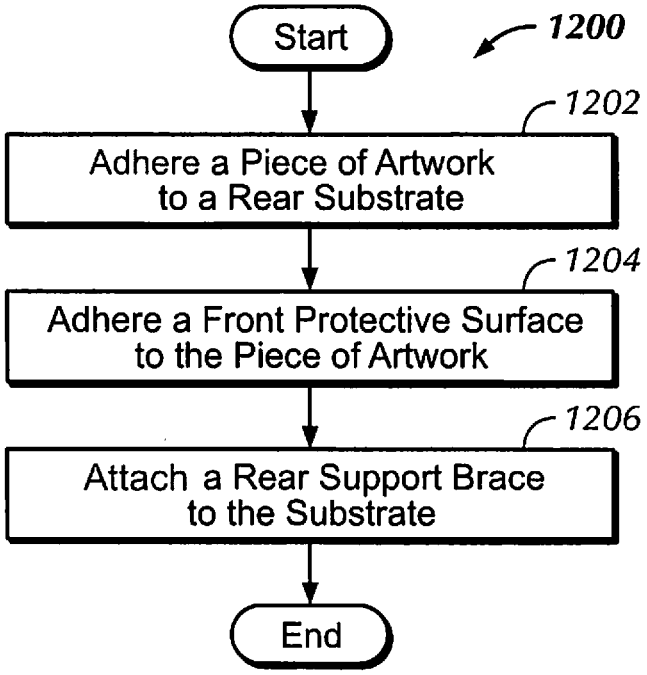
FIG. 12 is a flow chart showing one embodiment of a method for creating a sealed frame mount system.

FIG. 12 illustrates a schematic flow chart diagram for one embodiment of a method 1200 for making a sealed frame mount system such as that shown in FIG. 12. In one embodiment, the method 1200 starts at step 1202 of adhering a piece of artwork on the front side of a rear substrate. In some embodiments, adhering a piece of artwork may include printing the piece of artwork. As described above, the steps of printing a piece of artwork to a rear substrate may include, for example, using UV-cured inks on the front side of aluminum dibond. A flat bed printer can both print the artwork and cure the UV ink with UV lights, nearly simultaneously. In such an embodiment, the ink itself may serve to adhere the artwork to the rear substrate and an additional, separate, adhesive may not be necessary. The artwork then has an air-tight seal against the front side of the rear substrate that is free of air, heat, dust, or other contaminants. Method 1200 then goes on to step 1204 of adhering a front protective surface to the artwork. The step of adhering a front protective surface to a piece of artwork may include, for example, a transparent laminate that is rolled, brushed, poured, sprayed or pressed on top of the artwork. A UV cured liquid laminate can be rolled onto the artwork using a flatbed machine that both applies and cures the liquid laminate. In such an embodiment, the liquid laminate itself may serve to adhere the front protective surface to the artwork and an additional adhesive may not be necessary. Again, the artwork has an air-tight seal against the front protective surface that is free of air, heat, dust, or other contaminants. Finally, method 1200 includes step 1206 of attaching a rear support brace to the rear substrate. As described above, adhering or attaching the rear support brace to the rear substrate may include using rivets, double-sided tape, welding, and/or expanding adhesive such as Gorilla Glue.

All of the methods disclosed and claimed herein can be made and executed without undue experimentation in light of the present disclosure. While the apparatus and methods of this invention have been described in terms of preferred embodiments, it will be apparent to those of skill in the art that variations may be applied to the methods and in the steps or in the sequence of steps of the method described herein without departing from the concept, spirit and scope of the invention. For example, although acrylics such as plexiglass are described as possible materials for the front protective surface, it should be understood that other materials with similar qualities may be used. In addition, modifications may be made to the disclosed apparatus and components may be eliminated or substituted for the components described herein where the same or similar results would be achieved. All such similar substitutes and modifications apparent to those skilled in the art are deemed to be within the spirit, scope, and concept of the invention as defined by the appended claims.

What is claimed is:

1. A frame comprising:

a planar front protective surface comprising a smooth transparent thermoplastic;

a planar piece of artwork having a front side with an image and a back side;

an adhesive for irremovably adhering the front side of the piece of artwork to the front protective surface, where the adhesive adheres at least ninety-five percent of the entire front side of the piece of artwork to the front protective surface;

a rigid and planar rear substrate comprising aluminum;

a second adhesive for irremovably adhering the back side of the piece of artwork to the rear substrate, where the second adhesive adheres at least ninety-five percent of the entire back side of the piece of artwork to the rear substrate; and a rear support brace attached to the rear substrate;

where the front protective surface, the piece of artwork, the rigid rear substrate, and the rear support brace form a singular frame that is sufficiently rigid to maintain a planar shape while under a stress associated with hanging the frame on a wall.

2. The frame of claim 1, where the front protective surface is 0.25 inches thick.

3. The frame of claim 1, where the front protective surface is 0.125 inches thick.

4. The frame of claim 1, where the front protective surface is 0.0625 inches thick.

5. The frame of claim 1, where the front protective surface is 0.03125 inches thick.

6. The frame of claim 1, where the piece of artwork comprises a print of a photograph made on paper with a printer.

7. The frame of claim 6, where the paper comprises a border around the piece of artwork.

8. The frame of claim 1, where the piece of artwork comprises ink printed directly onto the front protective surface.

9. The frame of claim 1, where the piece of artwork comprises ink printed directly onto the rear substrate.

10. The frame of claim 1, where the aluminum is a sheet of 0.080 inch thick aluminum.

11. The frame of claim 1, where the rear substrate comprises aluminum composite panel.

12. The frame of claim 1, where the rear support brace is made of aluminum tubes.

13. The frame of claim 1, further comprising a third adhesive for adhering the rear substrate to the rear support brace.

14. The frame of claim 1, where a first panel comprises the front protective surface, the piece of artwork, the adhesive for adhering the piece of artwork to the front protective surface, the rear substrate, and the rear support brace; and a second panel comprises a second front protective surface, a second piece of artwork, a second adhesive for adhering the piece of artwork to the front protective surface, a second rear substrate, and a second rear support brace, where the first piece of artwork and the second piece of artwork are parts of a single larger piece of artwork.

15. The frame of claim 14, where the first piece of artwork and the second piece of artwork have a border.

16. The frame of claim 1, where the adhesive adheres the entire front side of the piece of artwork to the front protective surface; and where the second adhesive adheres the entire back side of the piece of artwork to the rear substrate.

17. A method of making a frame, the method comprising:

adhering at least ninety-five percent of an entire front side of a piece of artwork to a front protective surface, where the front protective surface comprises a smooth transparent thermoplastic, such that the piece of artwork is irremovably adhered to the front protective surface, where the front side of the piece of artwork has an image;

adhering a rigid rear substrate, where the rigid rear substrate comprises aluminum, to at least ninety-five percent of an entire back side of the piece of artwork such that the piece of artwork is irremovably adhered to the rear substrate; and attaching a rear support brace to the rear substrate;

where the front protective surface, the piece of artwork, the rigid rear substrate, and the rear support brace form a singular frame that is sufficiently rigid to maintain a planar shape while under a stress associated with hanging the frame on a wall.

18. The method of claim 17, where adhering the piece of artwork to the front protective surface comprises:

pressing an adhesive film to the front protective surface so as to remove substantially all air between the adhesive film and the front protective surface; and pressing the piece of artwork to the adhesive film so as to remove substantially all air between the adhesive film and the piece of artwork.

19. The method of claim 17, where adhering the rear substrate to the piece of artwork comprises:

pressing an adhesive film to the rear substrate so as to remove substantially all air between the adhesive film and the rear substrate; and pressing the piece of artwork to the adhesive film so as to remove substantially all air between the adhesive film and the piece of artwork.

20. The method of claim 17, further comprising removing a portion of the adhered front protective surface, piece of art work, and rear substrate.

21. The method of claim 20, further comprising polishing the edges of the front protective surface and rear substrate.

22. The method claim 17 further comprising:

adhering the entire front side of the piece of artwork to the front protective surface; and adhering the rear substrate to the entire back side of the piece of artwork.

* * * * *